US010683792B2

(12) United States Patent
Schmitz

(10) Patent No.: US 10,683,792 B2
(45) Date of Patent: Jun. 16, 2020

(54) ENGINE MANIFOLD ADAPTER

(71) Applicant: Jim's Tooling Solutions, LLC, Roscoe, IL (US)

(72) Inventor: James Schmitz, Roscoe, IL (US)

(73) Assignee: Jim's Tooling Solutions, LLC, Roscoe, IL (US)

( * ) Notice: Subject to any disclaimer, the term of this patent is extended or adjusted under 35 U.S.C. 154(b) by 752 days.

(21) Appl. No.: 14/915,694

(22) PCT Filed: Sep. 5, 2014

(86) PCT No.: PCT/US2014/054431
§ 371 (c)(1),
(2) Date: Mar. 1, 2016

(87) PCT Pub. No.: WO2015/035263
PCT Pub. Date: Mar. 12, 2015

(65) Prior Publication Data

US 2016/0230637 A1 Aug. 11, 2016

Related U.S. Application Data

(60) Provisional application No. 61/874,368, filed on Sep. 6, 2013.

(51) Int. Cl.

| | |
|---|---|
| ***F01N 1/00*** | (2006.01) |
| ***F01N 13/18*** | (2010.01) |
| ***F01N 13/10*** | (2010.01) |

(52) U.S. Cl.
CPC ..... *F01N 13/1805* (2013.01); *F01N 13/10* (2013.01); *F01N 13/1827* (2013.01); *F01N 13/1855* (2013.01); *F01N 2450/24* (2013.01)

(58) Field of Classification Search
CPC ... F01N 13/10; F01N 13/1805; F01N 13/1827
USPC ..... 60/323
See application file for complete search history.

(56) References Cited

U.S. PATENT DOCUMENTS

| | | | | |
|---|---|---|---|---|
| 3,716,992 | A | 2/1973 | Stahl | |
| 3,869,859 | A | 3/1975 | Thornburgh | |
| 4,022,019 | A | 5/1977 | Garcea | |
| 4,512,148 | A | 4/1985 | Jacobson | |
| 4,537,027 | A | 8/1985 | Harwood et al. | |
| 5,636,515 | A | 6/1997 | Matsumoto et al. | |
| 5,700,039 | A | 12/1997 | Manning | |
| 5,768,891 | A * | 6/1998 | Wagner | F01N 13/08 60/313 |
| 5,887,428 | A | 3/1999 | Garisto | |
| 5,961,153 | A | 10/1999 | Foster | |

(Continued)

*Primary Examiner* — Jason D Shanske
(74) *Attorney, Agent, or Firm* — Vidas, Arrett & Steinkraus

(57) ABSTRACT

An engine manifold adapter fluidly interconnects a fluid port of an internal combustion engine to a cylindrical conduit. The adapter comprises a stem portion extending for a flange portion. The stem portion has a pair of oppositely disposed openings formed therein. One of the openings is configured to conform to the fluid port and the other of the openings is configured to accommodate press fitting of the cylindrical conduit onto the other of the openings. A line of sight is formed between the openings. In one embodiment, the fluid port is an exhaust port and the cylindrical conduit is an exhaust pipe.

20 Claims, 4 Drawing Sheets

(56) References Cited

U.S. PATENT DOCUMENTS

| | | | | |
|---|---|---|---|---|
| 6,659,092 | B2 * | 12/2003 | Coleman | F02M 26/19 123/568.17 |
| 8,181,453 | B2 * | 5/2012 | Goplen | F01N 3/34 60/317 |
| 2002/0150518 | A1 | 10/2002 | Brush et al. | |
| 2003/0116145 | A1 * | 6/2003 | Coleman | F02M 26/19 123/568.17 |
| 2006/0162325 | A1 * | 7/2006 | Darley | F01M 13/00 60/317 |
| 2006/0196035 | A1 | 9/2006 | Opperman | |
| 2007/0095056 | A1 * | 5/2007 | Richter | F01N 13/10 60/313 |
| 2011/0047997 | A1 * | 3/2011 | Goplen | F01N 3/34 60/317 |
| 2011/0107753 | A1 | 5/2011 | Leroy et al. | |
| 2015/0226106 | A1 * | 8/2015 | Murakami | F01N 13/10 60/323 |

* cited by examiner

ENGINE MANIFOLD ADAPTER

CROSS-REFERENCES TO RELATED APPLICATION

This application is a national stage application of PCT Application No. PCT/US14/54431, filed Sep. 5, 2014, which claims the benefit of U.S. Provisional Application No. 61/874,368, filed Sep. 6, 2013, the entire content of which is incorporated herein by reference.

FIELD OF THE INVENTION

The present invention relates to combustion engines and, in particular, to an adapter with a universal opening for interconnecting a non-standard engine exhaust port to a standard exhaust pipe.

BACKGROUND OF THE INVENTION

Many seek to maximize the amount of power produced from a given amount of fuel and the power output per unit displacement of the engine cylinders in their internal combustion engines. This is especially true for car enthusiasts who often modify stock cars with aftermarket parts in an effort to increase the performance of the cars. One factor that must be addressed when attempting to have an engine reach peak performance is exhaust backpressure.

Backpressure refers to pressure/resistance that is opposed to the desired flow of a fluid in a confined place such as a pipe. Backpressure in a pipe is often caused by obstructions or tight bends in the pipe.

Exhaust backpressure refers to the pressure opposed to the desired flow of exhaust gases out of the engine. Complex shaped or reduced cross-sectional areas of exhaust piping can increase backpressure, which effectively requires the engine to use a greater portion of its power output to expel exhaust gases. Having to expend energy to expel exhaust gases decreases the amount of usable rotational power produced per unit fuel consumed, and is leads to cars with lower horsepower (HP) readings.

Multi-cylinder internal combustion engines typically employ exhaust manifolds (chambers that interconnect several openings) to direct engine exhausts from the individual cylinder exhaust ports to the downstream exhaust components, which can include exhaust pipes, catalytic converters, resonators, mufflers and/or tailpipes.

A major source of flow restriction in conventional engine designs occurs when exhaust manifold piping is forced to adopt a complex shape to match the exhaust port and/or is forced to follow sharp turns due to packaging considerations within the engine housing. Lessening flow restrictions on the exhaust path is a method of increasing engine efficiency.

A manifold adapter that reduces the difficulties and disadvantages of conventional engine designs by simultaneously reducing backpressure and improving exhaust system packaging in internal combustion engines would represent a significant advancement in the automotive field.

SUMMARY OF THE INVENTION

Shortcomings of prior engine manifold designs are overcome by an engine manifold adapter that smoothly interconnects a fluid port of an internal combustion engine to a cylindrical conduit. In other embodiments, the conduit can be non-cylindrical.

In some embodiments, the engine manifold can maintain a line-of-sight between the engine exhaust port and the discharge end of the adapter, thereby reducing obstructions in the exhaust flow path and decreasing backpressure. This is especially beneficial for turbo and supercharged engines. However, it should be noted that in other embodiments, the angle between the engine exhaust port, and the discharge end will be on in which line-of-sight is not possible. In these embodiments, the adaptor still provides benefits as illustrated in Table 1. This is likely due to a venturi effect taking place.

The data in Table 1 was obtained by running an engine on a dynamometer to measure the cubic feet per minute ("CFM"; liters per minute will be designated hereafter as "LPM") of an 8 inch (20.32 cm) long "cheater" pipe with a 2.125 inch (5.40 cm) internal diameter against a manifold adapter with a 1.66 inch (4.22 cm) internal diameter attached to a 1.875 inch (4.7625 cm) internal diameter pipe with a 2 inch (5.08 cm) external diameter and a 90 degree bend. The manifold adaptor was configured to hug the engine block, as is often desired when customizing a car with aftermarket parts.

As can be seen, the manifold adaptor with the attached pipe created a venturi effect that allowed the engine to climb all the way to 1.00 valve lift and reaching 240.7 CFM (6815.9 LPM). On the other hand, the straight 8 inch cheater pipe with the larger diameter maxed out around 234.3 CFM (6634.6 LPM) between 0.500 and 0.600 valve lift. This finding is in direct contrast to the commonly held belief that straighter and wider pipes will provide the best results. The manifold adaptor allows for larger flows in tight restrictive areas where a straight pipe cannot fit. This is especially advantageous in situations where space is a premium.

TABLE 1

| Valve Lift | Cheater Pipe | Manifold Adaptor |
|---|---|---|
| 0.10 | 64.3 CFM (1820.8 LPM) | 64.0 CFM (1812.3 LPM) |
| 0.20 | 130.8 CFM (3703.8 LPM) | 127.6 CFM (3613.2 LPM) |
| 0.30 | 181.8 CFM (5148.0 LPM) | 175.0 CFM (4955.4 LPM) |
| 0.40 | 214.6 CFM (6076.8 LPM) | 207.7 CFM (5881.4 LPM) |
| 0.50 | 234.3 CFM (6634.6 LPM) | 223.1 CFM (6317.5 LPM) |
| 0.60 | 234.0 CFM (6626.1 LPM) | 230.7 CFM (6532.7 LPM) |
| 0.70 | 232.7 CFM (6589.3 LPM) | 234.6 CFM (6643.1 LPM) |
| 0.80 | — | 236.4 CFM (6694.1 LPM) |
| 0.90 | — | 240.0 CFM (6796.0 LPM) |
| 1.00 | — | 240.7 CFM (6815.9 LPM) |

The adapter can also be manufactured to adapt to a universally-shaped round pipe to a range of cylinder head exhaust port shapes, including square, oval, rectangular, dogleg and other odd-shaped configurations. It was discovered that the use of uniform adaptors in multi-cylinder engines improved performance. The adaptor also allow for "timing" of an engine via the use of different pipe sizes to achieve improved engine performance in terms of torque and horsepower in particular revolution per minute (RPM) ranges.

The data in Table 2 was obtained by running an engine on a dynamometer to measure the amount of horsepower it is producing at various revolutions per minute. Two aftermarket headers were tested against the 1⅝ inch (4.13 cm) uniform manifold adaptors: namely a 1⅝ inch (4.13 cm) Hedman and a 1¾ inch (4.45 cm) Kustom. Both of these headers are considered to be high quality aftermarket components.

As can be seen from data, the uniform adaptors generally outperformed the current aftermarket, headers, especially in mid-range RPM. On average the adaptors allowed the engine to produce 5.6 more horsepower than the Hedman and 10.9 more horsepower than the Kustom. It is believed that this is partly because the adaptors allow for the gas expansion closer to the port that traditional headers.

It should be noted, that the Kustom header started outperforming the uniform adaptors at around 5900 RPM. It is believed this is due to the wider sized pipe of the Kustom.

It should also be noted that the Hedman outperformed the uniform adaptor at low RPM (roughly under 4000). It is believed that this can be explained by the fact that the Hedman header did not fit the port correctly and created back pressure. The motor benefited from this back pressure until the camshaft reached its power range (roughly 4000-5800 RPM).

TABLE 2

| RPM | Manifold Adaptor | Hedman Header | Kustom Header |
|---|---|---|---|
| 3200 | 187.75 HP | 196.70 HP | 162.4 HP |
| 3700 | 218.97 HP | 226.37 HP | 205.1 HP |
| 4250 | 278.26 HP | 270.95 HP | 250.4 HP |
| 4750 | 327.77 HP | 311.50 HP | 295.7 HP |
| 5300 | 352.01 HP | 339.10 HP | 337.9 HP |
| 5800 | 368.53 HP | 359.13 HP | 368.0 HP |
| 6100 | 362.69 HP | 352.93 HP | 373.0 HP |
| 6350 | 355.72 HP | 350.08 HP | 371.5 HP |

The adapter can also include a fitting to attach a section of curved pipe to the adapter discharge end opposite the cylinder head. This pipe section can be attached to the adapter in a number of ways, including metal inert gas (MIG) welding and tungsten inert gas (TIG) welding, and can be rotated 360 degrees for engine packaging considerations. This 360 degree rotation also allows for all the tubes to be equal coming off the manifold for a multi-style exhaust system. In some embodiments, all of the ports of the manifold adaptor are identical, or at least substantially identical to allow for equal flow on all cylinders. This, along with the equal length tubes, allows for the possibility of a true equal-flow system.

The adapter comprises a stem portion extending from a flange portion. The stem portion has a pair of oppositely disposed openings formed therein. One of the openings is configured to conform to the fluid port and the other of the openings is configured to accommodate press fitting of the cylindrical conduit onto the other of the openings. A line of sight is formed between the openings.

In one embodiment, the fluid port is an exhaust port and the cylindrical conduit is an exhaust pipe.

The flange portion preferably has at least one hole formed therein for accommodating a fastener therein to secure the flange portion to the engine at a location adjacent the fluid port. The fastener can be a threaded bolt insertable into a cooperating threaded hole formed in the engine.

The cylindrical conduit can be press fitted around the exterior of the stem at the other of the openings. The cylindrical conduit can also be press fitted around the interior of the stem at the other of the openings.

Shortcomings of prior engine exhaust manifold designs are overcome by an engine exhaust manifold adapter for fluidly interconnecting an exhaust port of an internal combustion engine to a cylindrical exhaust pipe. The adapter comprises a stem portion extending from a flange portion. The stem portion has a pair of oppositely disposed openings formed therein. One of the openings is configured to conform to the exhaust port and the other of the openings is configured to accommodate press fitting of the cylindrical exhaust pipe onto the other of the openings. A line of sight is formed between the openings.

In another embodiment the adapter fluidly interconnects a pair of adjacent exhaust ports of an internal combustion engine to a cylindrical exhaust pipe. The dual adapter comprises a pair of stem portions extending from a flange portion. Each of the stem portions has a pair of oppositely disposed openings formed therein. One of the openings is configured to conform to one of the exhaust ports and the other of the openings is configured to accommodate press fitting of the cylindrical exhaust pipe onto the other of the openings. A line of sight is formed between the openings.

The interior surfaces of the engine manifold adapter can be machined in the direction of exhaust flow to reduce turbulence and reversion.

The discharge end of the engine manifold adapter can be manufactured at a range of angles relative to the plane of the cylinder head exhaust port. Thus, an outlet opening formed in the discharge end can be oriented at a range of angles relative to an intake opening of the engine manifold adapter. The outlet opening can be nonparallel to the intake opening.

A gasket assembly can be used between the adapter and the cylinder head for sealing purposes. The adapter can be fabricated from steel, titanium, other metal alloys, carbon, composites and other materials suitable for engine exhaust components.

Use of the engine manifold adapter can also alter the acoustic profile of the exhaust system.

The engine manifold adapter can improve manifold packaging within the vehicle engine compartment and allow greater physical accessibility to exhaust components within the engine compartment. It can be used with, among others, shorty long-tube, log, and swept runner turbo manifolds. The engine manifold adaptor can angle the manifolds to maximize clearance for the steering column and fender walls.

The adapter can be designed with a slot to accept a polygonal washer on the hex bolt used to releaseably secure the adapter to the cylinder head. The extending ends of the polygonal washer can be folded upwardly against two opposing flat sides of a hex bolt, thereby preventing, or at least reducing, the chance that the hex bolt will loosen.

The engine manifold adapter can also provide a universal round opening with inside and outside diameters that accommodate standard pipe sizes.

The adapter can also allow the downstream exhaust components to be directed in a more convenient and accessible path than if the exhaust system components were connected directly to the engine exhaust port.

DETAILED DESCRIPTION OF PREFERRED EMBODIMENT

Figure 1:
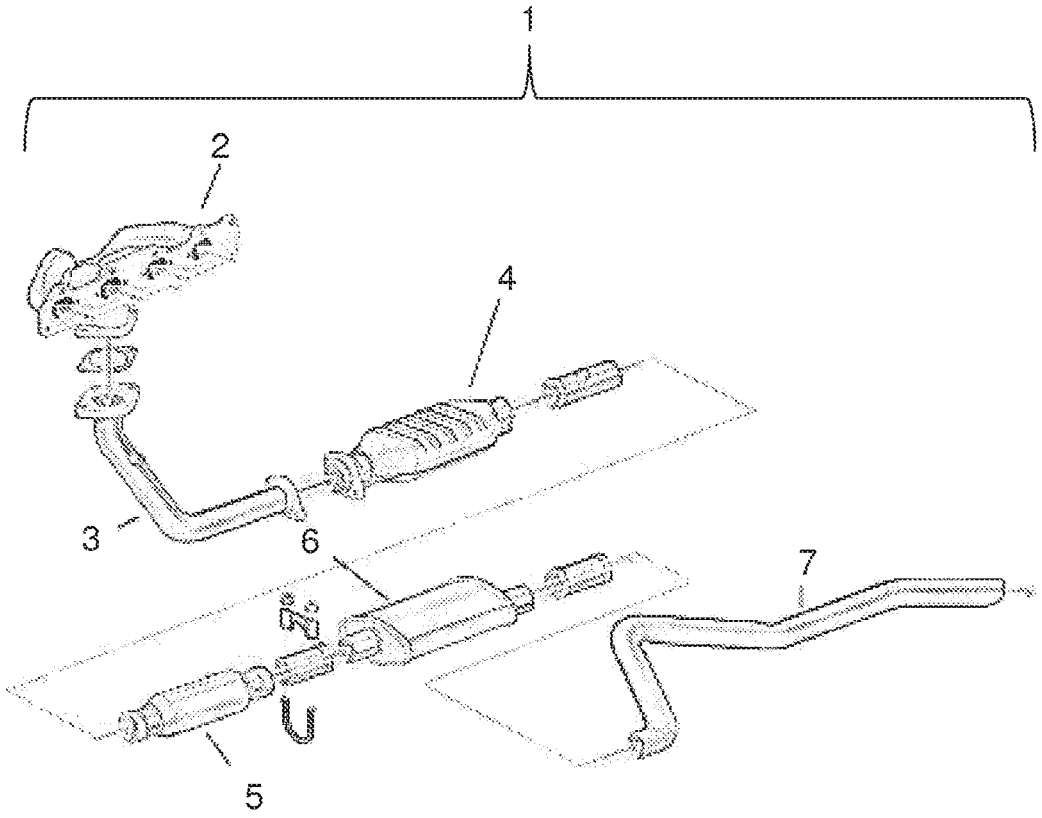
FIG. 1 is a schematic diagram Showing the components of an engine exhaust system

FIG. 1 is a typical schematic of exhaust manifold 2 directing engine exhaust stream from the engine cylinder head exhaust ports (not shown) to the downstream components of exhaust system 1. Traditional downstream components can include downpipe 3, catalytic converter 4, resonator 5, muffler 6, and/or tailpipe 7.

Figure 2:
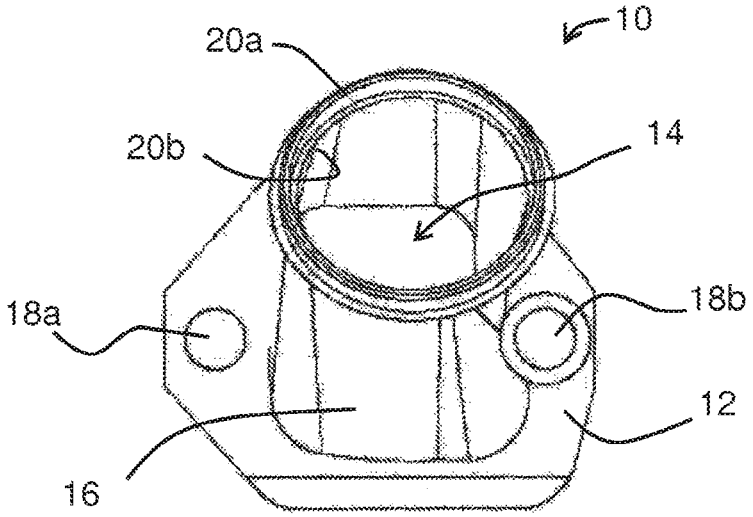
FIG. 2 is a perspective view of the discharge side of a first embodiment an engine manifold adapter, looking from the exhaust manifold towards the engine cylinder head.
Figure 3:
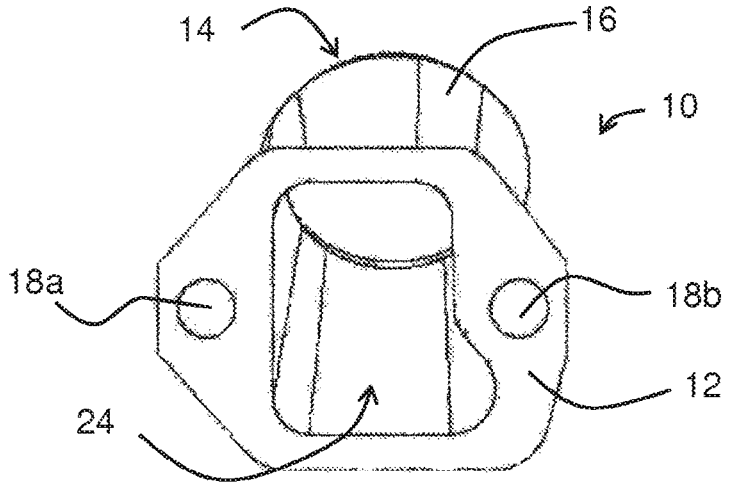
FIG. 3 is a perspective view of the engine side of the engine manifold adapter embodiment of FIG. 2, looking from the cylinder head towards the exhaust manifold.

Turning to FIGS. 2 and 3, manifold adapter 10 includes flange portion 12 and stem portion 16. Stem portion 16 terminates in a pair of openings: cylinder head exhaust port opening 24 that matches to a cylinder head exhaust port (not shown) and engine manifold opening 14 that attaches to an engine manifold (not shown) that directs the exhaust stream to any remaining downstream exhaust system components.

In some embodiments exhaust port opening 24 can have a groove around it (not shown) that can accommodate the use of an exhaust gasket (not shown) to provide extra sealing. In other embodiments, flange portion 12 can be made extra thick so adaptor 10 may be used without an exhaust gasket.

As further shown in FIGS. 2 and 3, flange portion 12 has a pair of holes 18*a* and 18*b* formed therein for receiving bolts (not shown) for attaching adapter 10 to threaded holes formed in the adjacent engine cylinder head (not shown). In some embodiments, adaptor 10 is specifically configured to accommodate the industry standard Automotive Racing Products (ARP) 12 point bolt heads. In other or the same embodiments, adaptor 10 is configured to accommodate fold-over-washers in conjunction with the bolts. These fold-over-washers assist in locking the bolts in place. In at least embodiment adaptor 10 can be configured so that the bolts are raised for easier installation and to allow for extra stock to compensate for any core shift.

Other methods of attaching adapter to the engine cylinder can be used as well in place of or in addition to bolts. Possible methods for attaching include, but are not limited to, metal inert gas (MIG) welding and tungsten inert gas (TIG) welding.

FIGS. 2 and 3 also show stem 16 having exterior surface 20*a* and interior surface 20*b* defined at opening 14. Exterior surface 20*a* and interior surface 20*b* can be sized such that a standard diameter pipe size can be press fitted onto exterior surface 20*a* and another standard diameter pipe can be press fitted within interior surface 20*b*.

Figure 4:
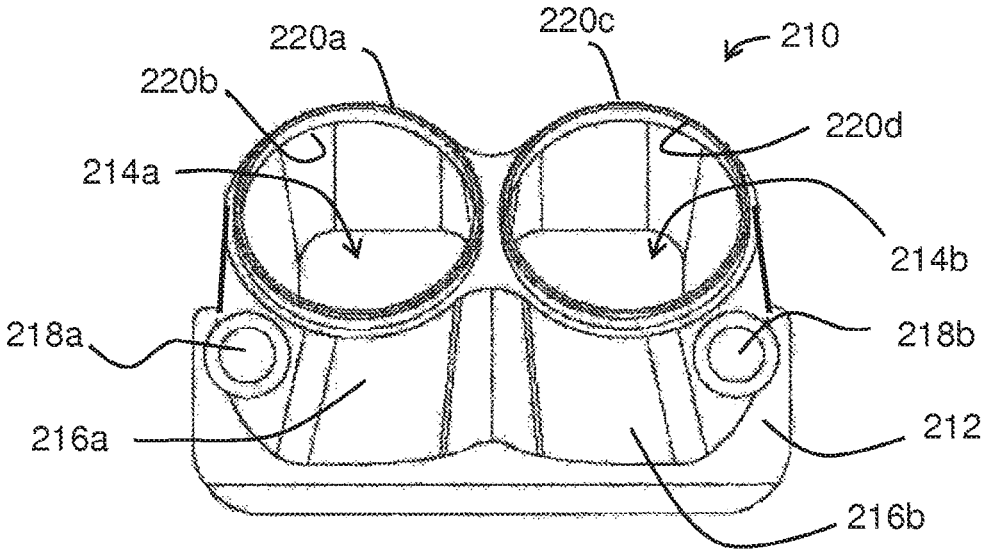
FIG. 4 is a perspective view of the discharge side of a third embodiment of the engine manifold adapter, looking from the exhaust manifold towards the engine cylinder head.
Figure 5:
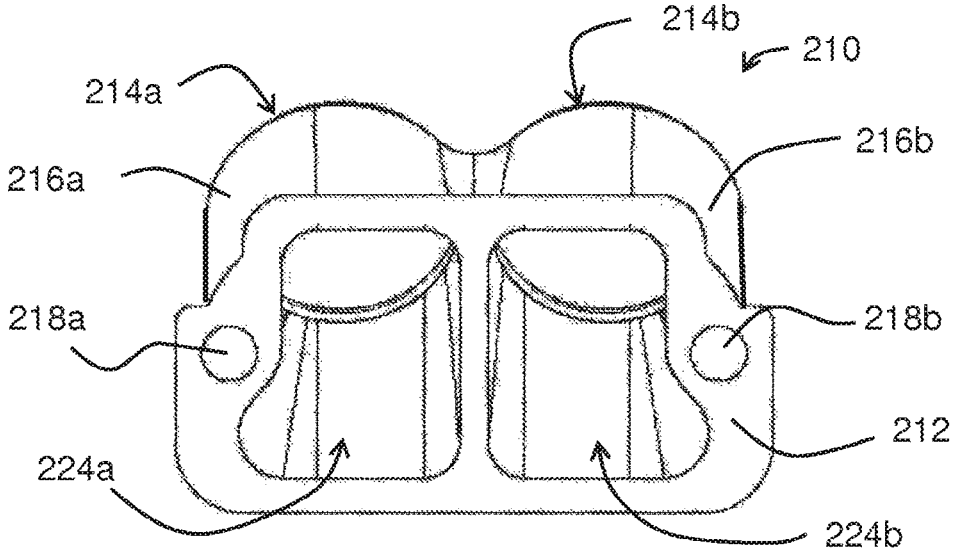
FIG. 5 is a perspective view of the engine side of the engine manifold adapter embodiment of FIG. 4, looking from the cylinder head towards the exhaust manifold.

Turning next to FIGS. 4 and 5, dual adapter 210 is configured to interconnect two adjacent cylinder head exhaust ports (not shown) to a standard diameter exhaust pipe (not shown). Dual adapter 210 includes a flange portion 212 and stem portions 216*a* and 216*b*. Stem portions 216*a* and 216*b* each terminates in a pair of openings. Opening 224*a* matches to a cylinder head exhaust port (not shown). Opening 224*b* matches to a neighboring cylinder head exhaust port (not shown). Openings 214*a* and 214*b* are located at the end of dual adapter 210 that is attached to the engine manifold that directs the exhaust stream to the remaining downstream exhaust system components.

As further shown in FIGS. 4 and 5, flange portion 212 has a pair of holes 218*a* and 218*b* formed therein for receiving bolts for attaching adapter 210 to threaded holes formed in the adjacent engine cylinder head.

FIGS. 4 and 5 also show stem 216*a* having a first raised lip having an exterior surface 220*a* and an interior surface 220*b* defined at opening 214. Similarly, stem 216*b* has a second raised lip that has an exterior surface 220*c* and an interior surface 220*d*. Exterior surfaces 220*a* and 220*c* are sized such that a standard diameter pipe size can be press fitted onto exterior surfaces 220*a* and 220*c*. Interior surfaces 220*b* and 220*d* are sized such that another standard diameter pipe can be press fitted within interior surfaces 220*b* and 220*d*.

Figure 6:
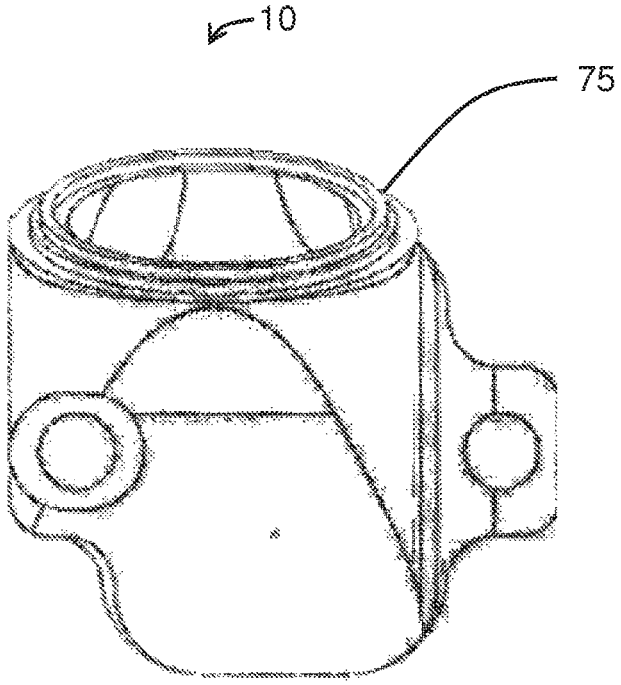
FIG. 6 is a perspective view of an engine manifold adapter with steps to accommodate various pipe widths.

In some embodiments, such as illustrated in FIG. 6, manifold adaptor 10 is configured to accept various sized pipes via steps 75. Not only do these steps allow for the tuning of the engine, but they also act as anti-reversion mechanisms to reduce backflow.

The engine manifold adapter can be used to improve the performance of naturally aspirated internal combustion engines, as well as engines using forced induction systems. The engine manifold adapter can also be used with other engine manifolds, such as an intake manifold.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. An engine manifold adapter comprising:

a flange portion comprising at least one hole formed therein for accommodating a fastener; and a stem portion extending from the flange portion, said stem portion comprising:

a port opening comprising an inlet: and a manifold opening comprising an outlet, the manifold opening configured to accommodate a cylindrical conduit;

wherein the port opening is oriented nonparallel to the manifold opening and a flowpath from the port opening to the manifold opening comprises a Venturi wherein a cross-sectional area of the port opening is greater than a cross-sectional area of the manifold opening; and said fastener is a threaded bolt insertable into a cooperating threaded hole formed in an engine.

2. The engine manifold adapter of claim 1, wherein said port opening is configured to attach to an exhaust port.

3. The engine manifold adapter of claim 1, wherein said cylindrical conduit is an exhaust pipe.

4. The engine manifold adapter of claim 1, wherein said flange portion has a second hole formed therein for accommodating a second fastener.

5. The engine manifold adapter of claim 1, wherein said cylindrical conduit is press fitted around the exterior of a raised lip at said manifold opening.

6. The engine manifold adapter of claim 1, wherein said cylindrical conduit is press fitted around the interior of a raised lip at said manifold opening.

7. The engine manifold adapter of claim 1, wherein said port opening is surrounded by a groove configured to accommodate an exhaust gasket.

8. The engine manifold adapter of claim 1, wherein said flange portion is configured to be used without an exhaust gasket.

9. The engine manifold adapter of claim 1, wherein said stem portion contains a first step and a second step, wherein said first step is configured to attach to a first sized cylindrical conduit and said second step is configured to attach to a second sized cylindrical conduit.

10. The engine manifold adapter of claim 1, wherein said port opening is non-circular.

11. The engine manifold adapter of claim 1, wherein said cylindrical conduit is attached to said stem portion via metal inert gas welding.

12. The engine manifold adapter of claim 1, wherein said adaptor is made of steel.

13. The engine manifold adapter of claim 1, wherein said cylindrical conduit is a turbo manifold.

14. An engine exhaust adapter comprising:

a body comprising an interior cavity, an inlet aperture in fluid communication with the interior cavity and an outlet aperture in fluid communication with the interior cavity;

the body configured for attachment to an engine and defining a flowpath for exhaust gases received from the engine, an end of the body comprising a flange arranged to abut the engine, the flange comprising at least one hole for accommodating a fastener;

the flowpath comprising a venturi wherein a cross-sectional area of the inlet aperture is greater than a cross-sectional area of the outlet aperture;

the inlet aperture oriented non-parallel to the outlet aperture.

15. The engine exhaust adapter of claim 14, wherein a central axis of the inlet aperture is oriented non-parallel to a central axis of the outlet aperture.

16. The engine exhaust adapter of claim 14, the inlet aperture comprising a non-circular shape.

17. The engine exhaust adapter of claim 14, the body comprising a flange, the flange defining mounting holes, the flange surrounding the inlet aperture.

18. The engine exhaust adapter of claim 14, the body comprising a raised lip defining the outlet aperture.

19. The engine exhaust adapter of claim 14, further comprising a pipe attached to the body in fluid communication with the outlet aperture, a cross-sectional area of the pipe being greater than the cross-sectional area of the outlet aperture.

20. The engine exhaust adapter of claim 14, wherein said fastener is a threaded bolt insertable into a cooperating threaded hole formed in the engine.

* * * * *